US006082928A

United States Patent [19]

Deniau et al.

[11] Patent Number: 6,082,928

[45] Date of Patent: Jul. 4, 2000

[54] DRAINING WALL, METHOD FOR PRODUCING SAME AND ELEMENT IMPLEMENTED THEREBY

[75] Inventors: Alain Deniau, Creteil; Alain Soriano, Sathonay Camp, both of France

[73] Assignee: Soletanche Bachy France, Nanterre, France

[21] Appl. No.: 09/029,084

[22] PCT Filed: Jun. 25, 1997

[86] PCT No.: PCT/FR97/01136

§ 371 Date: Feb. 19, 1998

§ 102(e) Date: Feb. 19, 1998

[87] PCT Pub. No.: WO97/49871

PCT Pub. Date: Dec. 31, 1997

[30] Foreign Application Priority Data

Jun. 26, 1996 [FR] France ..... 96 07945

[51] Int. Cl.[7] ..... E02B 11/00

[52] U.S. Cl. ..... 405/50; 405/36; 405/43; 405/267

[58] Field of Search ..... 405/36, 43, 50, 405/267, 266, 52; 210/747, 170

[56] References Cited

U.S. PATENT DOCUMENTS

| | | | |
|---|---|---|---|
| 245,721 | 8/1881 | Henning | 405/43 X |
| 320,667 | 6/1885 | Marquis | 405/43 X |
| 1,051,344 | 1/1913 | McKnight | 405/43 |
| 3,823,825 | 7/1974 | Bergles et al. | 405/43 X |
| 4,543,016 | 9/1985 | Tallard | 405/267 |
| 4,793,728 | 12/1988 | Ellis | 405/50 X |
| 4,863,312 | 9/1989 | Cavalli | 405/267 X |
| 4,934,865 | 6/1990 | Varkonyi et al. . | |

FOREIGN PATENT DOCUMENTS

| | | |
|---|---|---|
| 3 672 684 | of 0000 | Australia . |
| 2 265 920 | 6/1974 | France . |
| 2 014 368 | 3/1970 | Germany . |
| 3 741 001 | 12/1987 | Germany . |
| WO 85/02212 | 5/1985 | WIPO . |

*Primary Examiner*—Dennis L. Taylor
*Attorney, Agent, or Firm*—Burns, Doane Swecker & Mathis LLP

[57] ABSTRACT

A draining wall comprises a plurality of elementary panels (P) filled with a filtering material (10), wherein the panels are separated from one another by intermediate elements (J) and in that an element (2) connecting each pair of adjacent panels is embedded in the lower part of each intermediate element. The application also discloses a method and an element for its implementation. The invention is particularly useful for landslide areas.

12 Claims, 2 Drawing Sheets

DRAINING WALL, METHOD FOR PRODUCING SAME AND ELEMENT IMPLEMENTED THEREBY

The invention relates to a novel draining wall, to a method for producing it and to an element used in so doing.

The technique of the draining wall is well known. It is a technique which is derived from that of diaphragm walls for producing continuous French drains at depths (10–20 metres and more) which cannot be reached using conventional earthworking techniques. Such drains are produced by excavating under excavation fluid and by gravel-filling successive elemental panels which become communicating as the work progresses. For this, temporary shuttering is placed at one end of each panel N to allow the filtering material (gravel) of the panel N to be retained while the panel N+1 is being excavated. This shuttering is then removed after the end of the gravel-filling of the panels N and N+1 on either side of the said shuttering.

This technique is not always suitable for producing a draining wall in sloping land liable to slippage. This is because, since the wall is continuous over its entire height and over its entire length and therefore has a large surface area and since the panels already produced or in the process of being produced are full of excavation fluid (mixed with gravel in the case of the panels produced) up to ground level, the excavation fluid exerts a great deal of thrust on the downstream face of the wall and may cause the land to slip even before the wall has entered service.

In addition, the use of simple shuttering to separate the panel N+1 in the process of being made from the panel N already produced is often tricky and, in land in which excavation gives rise to irregular trench profiles, does not make it possible to avoid filtering material leaking from the panel N towards the panel N+1 during excavation of the latter.

The current technique does not allow continuity of the wall to be checked as it is being produced. This verification cannot be done until after the excavation fluid has been removed from the entire breadth of the wall, therefore after the wall has been completed.

The current technique does not allow entry into service by installments as construction progresses.

The current technique does not allow localized maintenance operations such as cleaning and re-excavation for changing the filtering material to be carried out without placing the entire wall under excavation fluid again and therefore again encountering the aforementioned drawbacks.

Finally, the current technique does not allow a continuous drainage pipe to be laid at the bottom of the wall.

The present invention sets out to overcome these problems and drawbacks by providing a novel type of draining wall.

The present invention is based on the concept of producing the French drain one panel at a time while at the same time providing means to allow the constituent panels of the drain to be placed in communication with one another at a later time with a view to making this drain operational.

More specifically, the invention relates to a draining wall consisting of a number of elemental panels (P) filled with a filtering material (10), characterized in that the said panels are separated from one another by intermediate elements (I) moulded in the soil and in that an element (2) placing each pair of adjacent panels in communication with each other is embedded in the lower part of each intermediate element.

The invention also relates to a method for producing a draining wall in accordance with the invention, characterized in that it comprises the following steps:

a) producing diggings or excavations E1 to En spaced along the line of the draining wall to be produced, these diggings or excavations being spaced apart by a distance which more or less corresponds to the length of one elemental panel of the wall and being produced under excavation fluid, b) positioning at the lower part of each of these diggings or excavations a tubular element including a permanent central part and destructible closed-off end parts, the said element pointing more or less along the direction of the draining wall to be produced and being slightly shorter than the digging or excavation, c) curing the excavation fluid lying in each of the said diggings or excavations or substituting a curable material for this fluid so as to form intermediate elements J1 to Jn made of cured material moulded in the soil, d) excavating, under excavation fluid, a first elemental trench between the intermediate elements J1 and J2 obtained in c), and destroying the destructible closed-off end parts 4, 5) of the elements embedded at the base of the said intermediate elements, which parts point towards the said trench, e) filling the length of trench obtained in d) with a filtering material, and removing the excavation fluid which lies in the said length of trench in order to obtain a first elemental panel, f) closing off the central part of the element embedded in the intermediate element J2 at an arbitrary stage in the method, but before the next step g), g) excavating, under excavation fluid, a second elemental trench between the intermediate elements J2 and J3 obtained in c), and destroying the destructible closed-off end parts of the elements embedded at the base of the said intermediate elements, which parts point towards the said trench, h) filling the length of trench obtained in g) with a filtering material, and removing the excavation fluid which lies in the said length of trench in order to obtain a second elemental panel, i) closing off the central part of the element embedded in the intermediate element J3 at an arbitrary stage in the method, but before the next step, and so on until the work is completed, and j) opening the central part of each element embedded in any arbitrary intermediate element at any arbitrary moment after the excavation fluid lying in the elemental trenches situated on either side of this intermediate element has been removed.

According to an embodiment, the cured material of the intermediate elements is cuttable, the excavating step (d) is carried out so that the excavating tool (9) cuts into the sides of the intermediate elements J1 and J2 adjacent to said trench, and the excavating step (g) is carried out so that the excavating tool (9) cuts into the sides of the intermediate elements J2 and J3 adjacent to said trench.

According to another embodiment, the excavation steps d) and g) are carried out without cutting into the sides of the intermediate elements J1 and J2, and J2 and J3, respectively, the destructible closed-off end parts of the elements embedded at the base of the intermediate elements being destroyed in some other appropriate way, for example using a means or implement provided inside the permanent central part of the tubular element or introduced into the latter from the soil. With this alternative form, it is obviously not necessary for the material of which the intermediate elements are made to be cuttable.

Optionally, if desired, the method may furthermore include the laying of perforated drainage pipes connecting the tubular elements of two successive intermediate elements together and acting as receivers, before the filtering material is put in place.

The invention finally relates to a tubular element which can be used for carrying out the method of the invention and/or producing a French drain in accordance with the invention, which includes a permanent central tubular part made of a relatively strong material (for example made of metal), destructible closed-off tubular end parts, made of a relatively fragile material (for example made of plastic), and a means of temporarily closing off the said central part.

According to a preferred embodiment, the said closing-off means can be operated from the soil surface.

According to a specific embodiment, the said closing-off means comprises an inflatable element, such as a balloon, which can be inflated and deflated from the soil surface. As an alternative, a valve may be used as a reversible closing-off means.

The intermediate elements may have a cross section of any shape, for example square, rectangular or circular. The dimension of the intermediate elements perpendicular to the trench may be greater than or equal to the thickness of the French drain to be produced. A greater breadth may be advantageous, especially in loose ground, in order to minimize the risk of excavation fluid creeping round the intermediate element.

The intermediate elements may be produced as the result of the curing of the excavation fluid when the latter is curable, for example when a curable slurry is used as excavation fluid, or alternatively by substituting a curable material (for example a grout or a plastic concrete) for the excavation fluid when the latter is not curable.

When use is made of a curable slurry for producing the intermediate elements, this slurry may be of any kind provided that it hardens to a cured material with enough cohesion to fulfil its role as an intermediate element. As nonlimiting example, a slurry based on bentonite and cement may be used. Once cured, the slurry can easily be cut by the excavation tool.

The excavation fluids that can be used for excavating the elemental trenches between the intermediate elements need to be non-curable and nonclogging. Such fluids can be prepared from well-known products available commercially from various suppliers. Mention may be made, for example, of REVERT® manufactured by the company JOHNSON, distributed by JOHNSON FILTRATION SYSTEMS, Z.I. 86530 Availles. The rheology of these fluids is readily adjustable by following the manufacturers' recommendations. The non-clogging properties are usually the result of the fluid being biodegradable.

The type of filtering material placed in the elemental trenches which form the French drain is not critical. This material is usually formed of sand, gravel and shingle, the granulometry and proportions of which are selected to suit the prevailing conditions on the site of the French drain. Those skilled in the art will know how to select an appropriate material for each situation.

The description which follows will be given with reference to the drawings in which.

Figure 1:
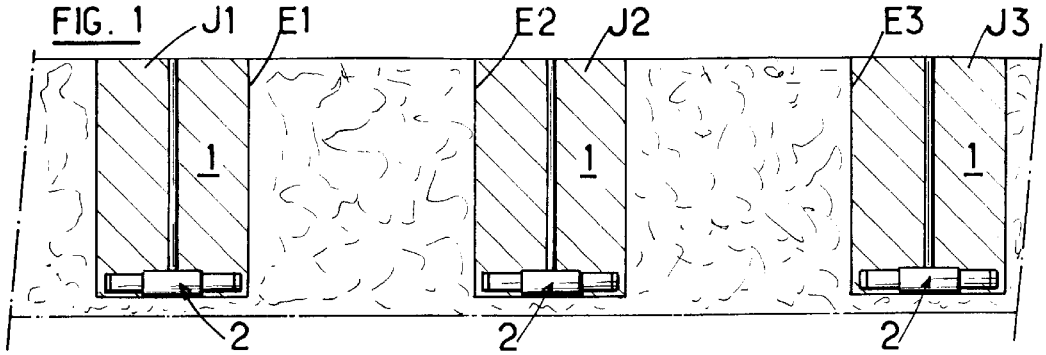
FIGS. 1 to 6 are diagrammatic sectional views illustrating the various steps in the method of the invention and the finished French drain obtained.

The various steps in producing a French drain using the method of the invention have been represented in FIGS. 1 to 6.

The first step is to make excavations E1 to En, for example, under curable excavation fluid 1, just three of which excavations have been represented (FIG. 1) in an attempt to simplify the drawing. Furthermore, it should be noted that the excavations E1 to En need not all be made before the start of the next steps. Those skilled in the art will understand that it would be possible, for example, to make three excavations E1–3 first of all, produce the two elemental draining panels situated between the intermediate elements moulded in these excavations, then make the excavations E4–6 and so on.

Figure 7:
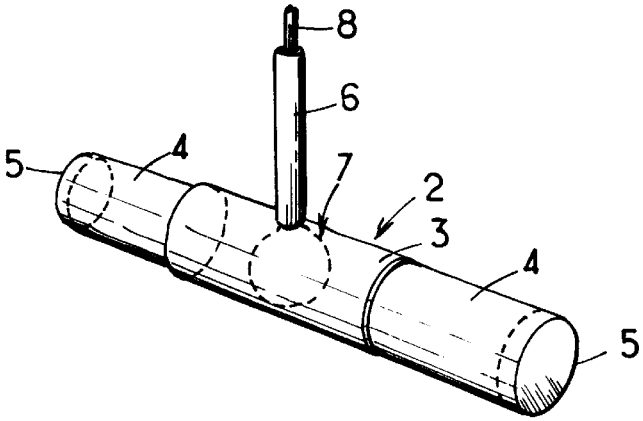
FIG. 7 is a diagrammatic perspective view of a tubular element used in the method of the invention.

Before the excavation fluid sets, a tubular element 2, illustrated in detail in FIG. 7, is lowered into each of these excavations, this element comprising a central part 3 made of metal into which is slipped, concentrically, a pipe 4 which is closed at its ends by membranes 5, made of plastic, the pipe being longer than the part 3 but slightly shorter than each of the excavations E. The element 2 furthermore includes a tube 6 perpendicular to the central part 3, connected to this part and communicating with the inside of the pipe 4 by mean of suitable holes in the central part and in the pipe 4. The tube 6 extends up above soil level. The element finally includes an inflatable balloon 7 situated inside the pipe 4, in line with the tube 6, which can be inflated or deflated from the soil surface by means of a small hose 8 running inside the tube 6. The element 2 points more or less parallel to the direction of the drain.

The element 1 can rest on the bottom of the excavation that receives it, as represented, but this is not compulsory.

Figure 2:
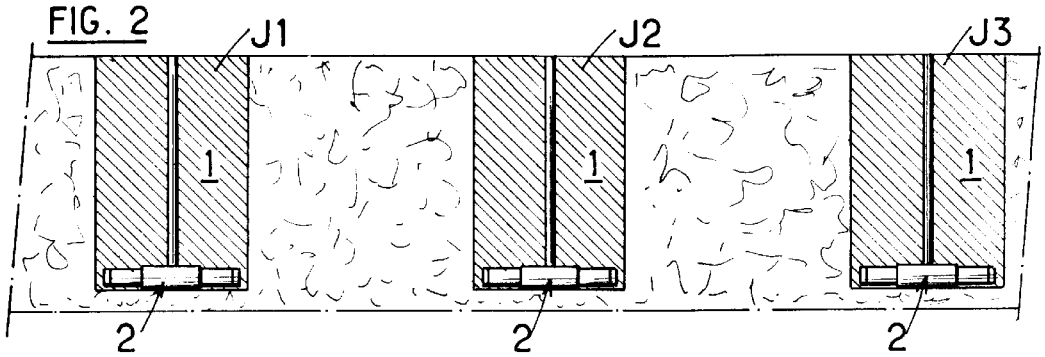

The excavation fluid is then left to set in the excavations E1–3, this resulting in the formation of intermediate elements J1 to J3 moulded in the soil and enclosing at their bottom end the elements 2 (FIG. 2).

Figure 3:
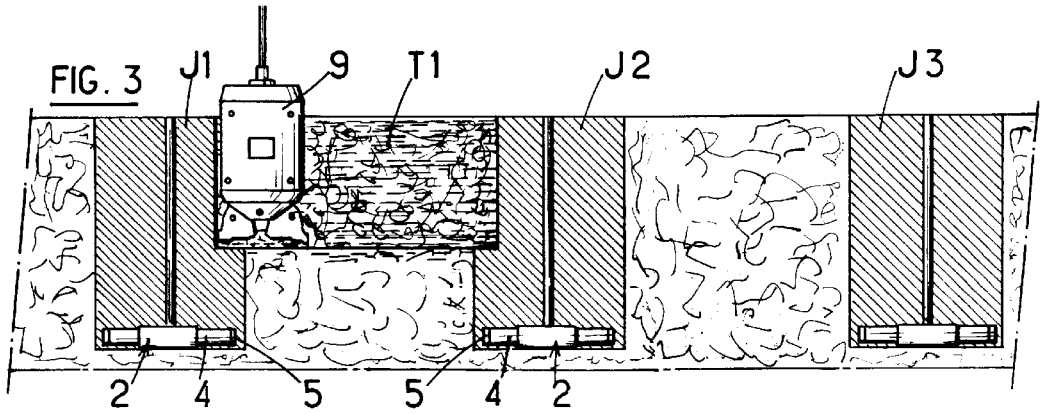
Figure 4:
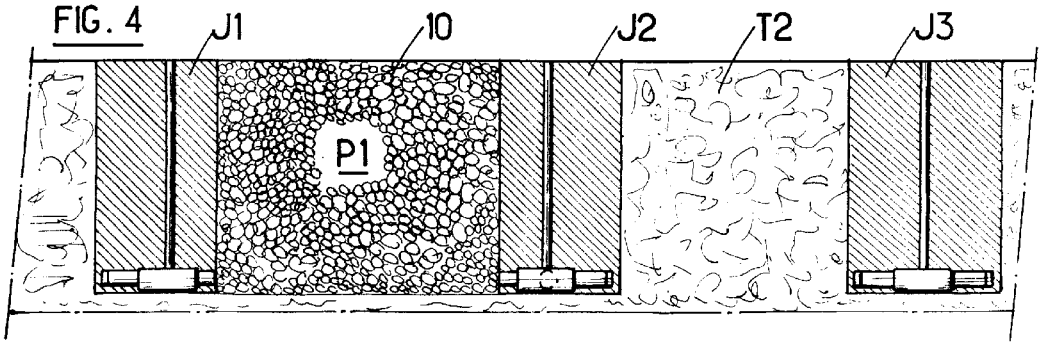

The next step is to excavate, under non-curable excavation fluid, an elemental trench T1 between the intermediate elements J1 and J2 using a suitable implement 9, such as an excavation bucket or the like, contriving for the implement to bite into the sides of the intermediate elements J1 and J2 pointing towards the trench T1. As it does this, the implement will in particular break off the ends of the plastic pipe 4 which point towards T1, especially destroying the membranes 5 (FIG. 3). Once the trench T1 is finished, it is filled with an appropriate filtering medium 10, at the same time pumping out the excavation fluid in order to remove this fluid from T1 (FIG. 4). A first elemental panel P1 is thus obtained.

It is then possible to proceed to the excavation, still under non-curable excavation fluid, of the elemental trench T2 between the intermediate elements J2 and J3. However, before making T2, it is necessary to ensure that the inflatable balloon 7 is closing off the tubular element at its central part. For this, the balloon 7 may be inflated either before the element 2 is positioned in the excavation, or afterwards, but in any case before the trench T2 is made.

It is essential that the tubular element be closed off during production of the trench T2, at least when the excavation implement reaches the level of the element 2, because if this were not the case the excavation fluid filling T2 would pass through the element 2 and would invade the trench T1 produced earlier, and this would undermine the stated objective of the invention which is to have just one elemental trench at a time full of excavation fluid.

Figure 5:
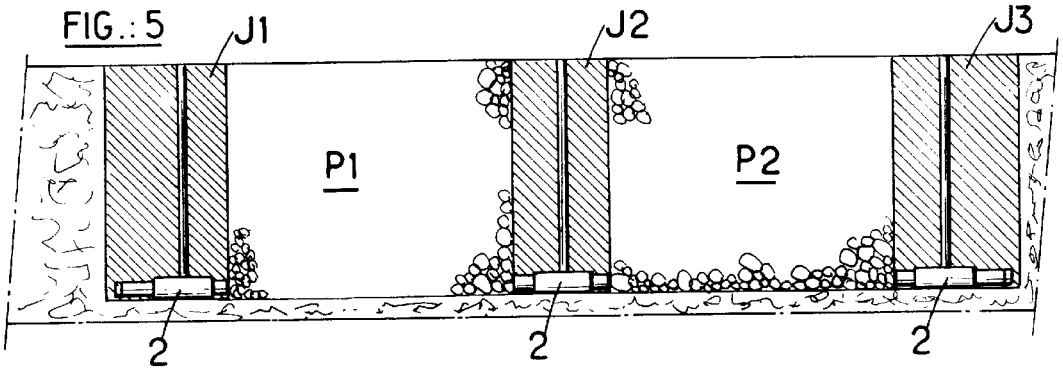

The elemental trench T2 is excavated in the same way as the elemental trench T1, destroying the closed-off ends of the elements 2, then filtering material is tipped into T2 while at the same time pumping out the excavation fluid (FIG. 5). A second elemental panel P2 is thus obtained.

The next elemental panels P3 to Pn are produced in the same way as described for P1 and P2, until the French drain is completed.

Lastly, each tubular element 2 has to be unblocked to ensure that the various elemental panels which make up the French drain communicate in service. For this, the balloons 7 can be deflated then extracted simply by pulling on the hoses 8 from the soil surface. A specific balloon can be removed at any moment once the two elemental trenches flanking the element 2 containing the said balloon have been emptied of their excavation fluid.

It should be noted that after the balloons have been removal, the tubes 6 may find a use as piezometers, as well as for maintaining the passages formed between the elemental panels. This is because they can be used to convey a jet of pressurized air or water for the purpose of rinsing out or unblocking these passages.

Figure 6:
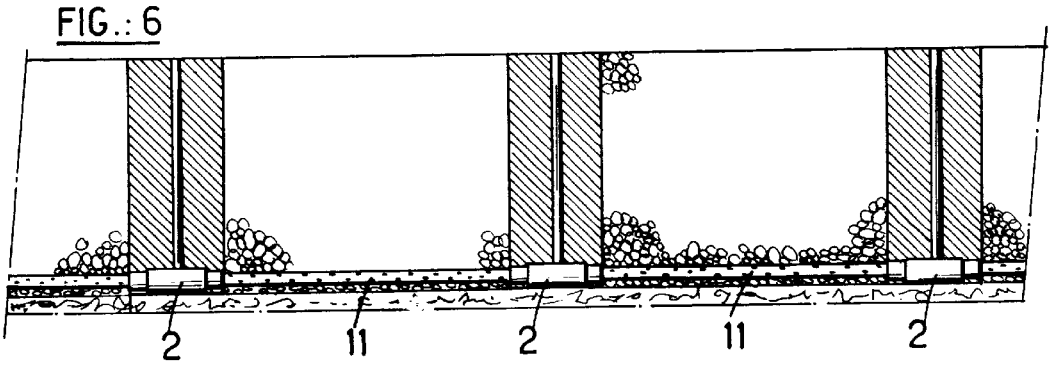

FIG. 6 illustrates an optional alternative form which includes a step of positioning perforated pipes 11 which act as receivers, between the elements 2. This optional step is carried out on completion of the excavation of each elemental trench, before the filtering material is tipped in. The openings of the tubular elements in the excavation fluid can be located more readily, so that the pipes 11 can be coupled there, using an ultrasound identification device which is known per se.

As a non limiting indication, the draining wall may be 40–150 cm thick and have a depth of 10 to 20 m and more. The intermediate elements may be 1.5 to 2 m long, and the elemental trenches may be 4 to 12 m long.

It goes without saying that the embodiments described are merely examples and that they could be modified, especially by substituting equivalent techniques, without thereby departing from the scope of the invention.

What is claimed is:

1. A draining wall comprising:

a number of elemental panels, each of the panels comprising a trench filled with a filtering material, said panels are separated from one another by intermediate elements moulded in soil, and an element placing each pair of adjacent panels in communication with each other is embedded in a lower part of each intermediate element.

2. The draining wall according to claim 1, wherein said intermediate elements have a square, rectangular or circular cross section.

3. A method for producing a draining wall in soil, which method comprises the following steps:

a) producing excavations spaced along a line of the draining wall to be produced, these excavations being spaced apart by a distance which substantially corresponds to a length of one elemental panel of the draining wall, under a first excavation fluid, b) positioning at the lower part of each of the excavations a tubular element including a permanent central part and destructible closed-off end parts, said tubular element pointing more or less along the line of the draining wall to be produced and being slightly shorter than said respective excavation, c) curing the first excavation fluid lying in each of said excavations or substituting a curable material for the first excavation fluid so as to form intermediate elements made of cured material moulded in the soil, d) excavating, under a second excavation fluid, a first trench between an adjacent pair of the intermediate elements obtained in c), and destroying the destructible closed-off end parts of the tubular elements embedded at the base of said intermediate elements, which end parts point towards said first trench, e) filling the trench obtained in d) with a filtering material, and removing the second excavation fluid which lies in said trench in order to obtain a first elemental panel, f) closing off a central part of the tubular element embedded in one of the intermediate elements at an arbitrary stage in the method, but before the next step g), g) excavating, under a second excavation fluid, a second trench between the one intermediate element and an adjacent intermediate element, and destroying the destructible closed-off end parts of the elements embedded at the base of said intermediate elements, which parts point towards said second trench, h) filling the second trench obtained in g) with a filtering material, and removing the second excavation fluid which lies in the second trench in order to obtain a second elemental panel, i) closing off the central part of the element embedded in the adjacent intermediate element at an arbitrary stage in the method, but before the next step, and so on until the work is completed, and j) opening the central part of each element embedded in any arbitrary intermediate element at any arbitrary moment after the excavation fluid lying in the elemental trenches situated on either side of this intermediate element has been removed.

4. The method according to claim 3, wherein the cured material of the intermediate elements is cuttable, wherein the excavating step (d) is carried out so that the excavating tool cuts into the sides of the intermediate elements adjacent to said trench, and wherein the excavating step (g) is carried out so that the excavating tool cuts into the sides of the intermediate elements adjacent to said trench.

5. The method according to claim 4, wherein the closed-off end parts are destroyed by a means or implement provided inside the permanent central part of the tubular element or introduced into the latter from the soil surface.

6. The method according to claim 3, which further includes the laying of perforated pipes connecting the tubular elements of two successive intermediate elements together and acting as receivers, before the filtering material is put in place.

7. The tubular element to be used in the method of claim 3, which tubular element includes a permanent central tubular part made of a relatively strong material, destructible closed-off tubular end parts, made of a relatively fragile material, and a means for temporarily closing off the central part.

8. The tubular element according to claim 7, wherein said closing-off means is operated from the soil surface.

9. The tubular element according to claim 7, wherein said closing-off means comprises an inflatable element, which can be inflated and deflated from the soil surface.

10. The tubular element according to claim 7, wherein said closing-off means comprises a valve.

11. A draining wall comprising:

a number of elemental panels, each of the panels comprising a trench filled with a filtering material, said panels are separated from one another by intermediate elements moulded in soil, a communication element placing each pair of adjacent panels in communication with each other is embedded in the lower part of each intermediate element, and a tube having one end above the soil and another end connected to the communication element.

12. A draining wall comprising:

a number of elemental panels, each of the panels comprising a trench filled with a filtering material, said panels are separated from one another by intermediate elements moulded in soil, a communication element placing each pair of adjacent panels in communication with each other is embedded in the lower part of each intermediate element, and a closing means in the communication element for closing off the communication element.

* * * * *